United States Patent [19]

Davis et al.

[11] Patent Number: 4,862,649

[45] Date of Patent: Sep. 5, 1989

[54] MATERIAL TRANSFER SYSTEM

[75] Inventors: Daren C. Davis, Grand Prairie; George A. Earle, III, Dallas, both of Tex.

[73] Assignee: LTV Aerospace & Defense Co., Dallas, Tex.

[21] Appl. No.: 901,482

[22] Filed: Aug. 28, 1986

[51] Int. Cl.[4] ..... B24B 7/00

[52] U.S. Cl. ..... 51/437; 414/221; 406/25; 406/169

[58] Field of Search ..... 51/436, 415, 437; 222/152; 406/23, 171, 24, 25, 21, 169; 414/221, 296, 295, 289

[56] References Cited

U.S. PATENT DOCUMENTS

| | | | |
|---|---|---|---|
| 2,193,738 | 3/1940 | Perrin | 406/169 |
| 3,727,985 | 4/1973 | Reuter | 406/25 |
| 3,858,733 | 1/1975 | Morioka et al. | 414/295 |
| 3,994,097 | 11/1976 | Lamb | 51/436 |

FOREIGN PATENT DOCUMENTS

| | | | |
|---|---|---|---|
| 0003409 | of 1913 | United Kingdom | 51/431 |

*Primary Examiner*—Frederick R. Schmidt
*Assistant Examiner*—Blynn Shideler
*Attorney, Agent, or Firm*—James M. Cate

[57] ABSTRACT

A material transfer system is provided having particular utility in cooperation with a liquid jet abrasive cutting system in which a continuous supply of abrasive, particulate material is required for abrasive cutting operations. Primary and secondary hoppers are provided for containing the abrasive particulate material, and the secondary hopper is suitably located at a position adjacent to the work station and remote from the primary hopper. The secondary hopper is provided with a first chamber and a second, lower chamber positioned beneath the first chamber. Means for evacuating the first chamber but not the second chamber is provided, and a check valve communicates between the upper and lower chambers for preventing communication between the upper and lower chambers upon the evacuation of the upper chamber; when open, the valve provides communication to the lower chamber, under normal atmospheric pressure, in response to the presence of a supply of abrasive, particulate material within the upper chamber portion.

13 Claims, 6 Drawing Sheets

MATERIAL TRANSFER SYSTEM

TECHNICAL FIELD

This invention relates to material transfer apparatus and, more particularly, to an improved material transfer apparatus adapted for use with a fluid powered, abrasive cutting system.

BACKGROUND ART

Material transfer apparatus are commonly employed for transferring particulate or fungible materials from one container to another, or from a supply container to a desired location. In abrasive blasting operations, for example, a hopper is commonly employed for containing a supply of sand or other abrasive material, and an evacuated conduit or hose may be connected between the hopper and the grit blasting nozzle, the supply hose necessarily being of sufficient length to reach from the hopper to the work area. In the use of such systems for sand blasting operations and the like, a high pressure air supply connected to the abrasive ejector nozzle may be employed to effect a vacuum in the supply hose sufficient to provide a flow of abrasive to the nozzle from a hopper remote from the work station. It will be understood by those in the art that, while the flow of abrasive material through the nozzle in a typical system may vary and may occasionally be interrupted because of obstructions in the hose or nozzle, flexing of the hose, or the like, such flow stoppages are not of major concern in typical sandblasting operations in that they may be readily corrected. Variations in flow rate may be compensated for by corrective procedures employed by a skilled operator as he observes and controls the operation of the blasting nozzle upon a workpiece.

Similar transfer systems have been employed for feeding particulate abrasive materials to modern fluid powered abrasive cutting systems such as those employed abrasive water jet cutting nozzles. Such systems employ an ejector nozzle powered by a liquid, such as water, supplied at very high pressures (e.g., in the order of 50,000 p.s.i. or greater). In typical applications, the high pressure fluid flow through the nozzle induces a vacuum in a supply tube communicating with a hopper containing an abrasive grit, such as garnet, silica, aluminum oxide, or the like. Air flow is induced within the supply tube and the abrasive is thus drawn from the hopper to the cutting nozzle. The vacuum produced by the flowing liquid is not as great, however, as that produced by a typical air powered sandblasting nozzle or the like, and the practicable length of tubing extending to the hopper containing the abrasive is thus undesirably limited. In automated, robotically controlled fluid jet cutting systems, for example it may be desired that the robot and the cutting jet nozzle be moveable over substantial distances and freed from constraints resulting from limited range between the abrasive hopper and the water jet nozzle. In our experiments, we have found that the supplemental use of air pressure to urge the abrasive grit toward the cutting nozzle tends to induce problems, such as stoppages and erratic flow. Thus, the limited range of the abrasive supply hose is an undesirable limitation in current automated robotic cutting systems.

Of perhaps even greater significance, however, is the requirement in such automated systems for a continuous and steady flow of the abrasive to the nozzle for effecting a continuous, even cut or Kerf through the workpiece. This requirement is of major importance when automated cutting operations are entailed and when such abrasive cutting jets are employed for cutting various composites, such as composite laminates of graphite epoxy, or Kevlar. In the latter instances it is essential that the abrasive be continuously entrained in the fluid jet to preserve the structural integrity of the workpiece. This is because the high pressure liquid does not effectively penetrate such materials without the additional, abrasive action of the grit, for the following reasons.

In normal, continuous cutting operations, the ejected water and abrasive jet penetrates the workpiece and is collected in a suitable receptacle or "catcher". Thus, kinetic energy of the liquid jet, which may exit the nozzle at velocities in excess of twice the speed of sound, is dissipated in the catcher. In the event however that the abrasive flow is interrupted and the liquid jet does not penetrate the workpiece, the jet becomes trapped within the body of the laminate rather than passing through, and the energy of the jet becomes dissipated within the laminate. The end result of such a stoppage is that the liquid stream is diverted outwardly within the laminate and the very high inertial and kinetic energy entailed in the liquid stream may produce delamination, and effect destruction of the workpiece. As will be understood by those in the art, large composite workpieces entailed in applications such as aerospace manufacturing may be the product of several previous manufacturing and assembly operations and may thus represent substantial manufacturing costs. It is thus apparent that interruptions of the supply of grit to such a liquid abrasive jet nozzle may entail serious consequences and should be avoided.

It has been found that gravity feed supply lines provide a more reliable and constant flow of abrasive to such water jet cutters. However, conventional gravity flow systems would not be practicable for automated, robotically operated systems because the provision of a large supply hopper adjacent to the cutter and the work area would be impracticable, and the use of a smaller, more portable hopper entails the disadvantage that the hopper must be refilled at undesirable frequent intervals.

OBJECTS OF THE INVENTION

It is, therefore, a major object of the present invention to provide a new and improve material transfer system.

It is a further object of the invention to provide such a material transfer system adopted for use in supplying a constant stream of abrasive material to a remotely located water jet cutting nozzle.

Yet another object is to provide such as transfer system in which the supply of abrasive materials fed to the nozzle is uninterrupted and of relatively constant velocity.

Another object of the invention is to provide such a system which is operable to supply abrasive grit to a work station located substantial distances from a primary container of the abrasive material.

Yet another of the invention is to provide such system which is particularly adapted for use in automated, robotically operated cutting operations, wherein cutting operations may be extended over a substantial period of time without necessitating refiling at frequent intervals of the supply hopper.

Yet another object is to provide such a system in which the flow of abrasive grit to the cutting nozzle is under gravity flow.

Another object is to provide a system having the above-stated advantages which is at the same time of reliable, practicable construction, and of lower cost of manufacture and installation than prior-art systems.

Other objects and advantages will be apparent from the specification and claims and from the accompanying drawing illustrative of the invention.

BRIEF DESCRIPTION OF THE DRAWINGS

The present invention can be more completely understood by reference to the following Detailed Description taken in conjunction with the accompanying drawings in which.

DETAILED DESCRIPTION

Figure 1:
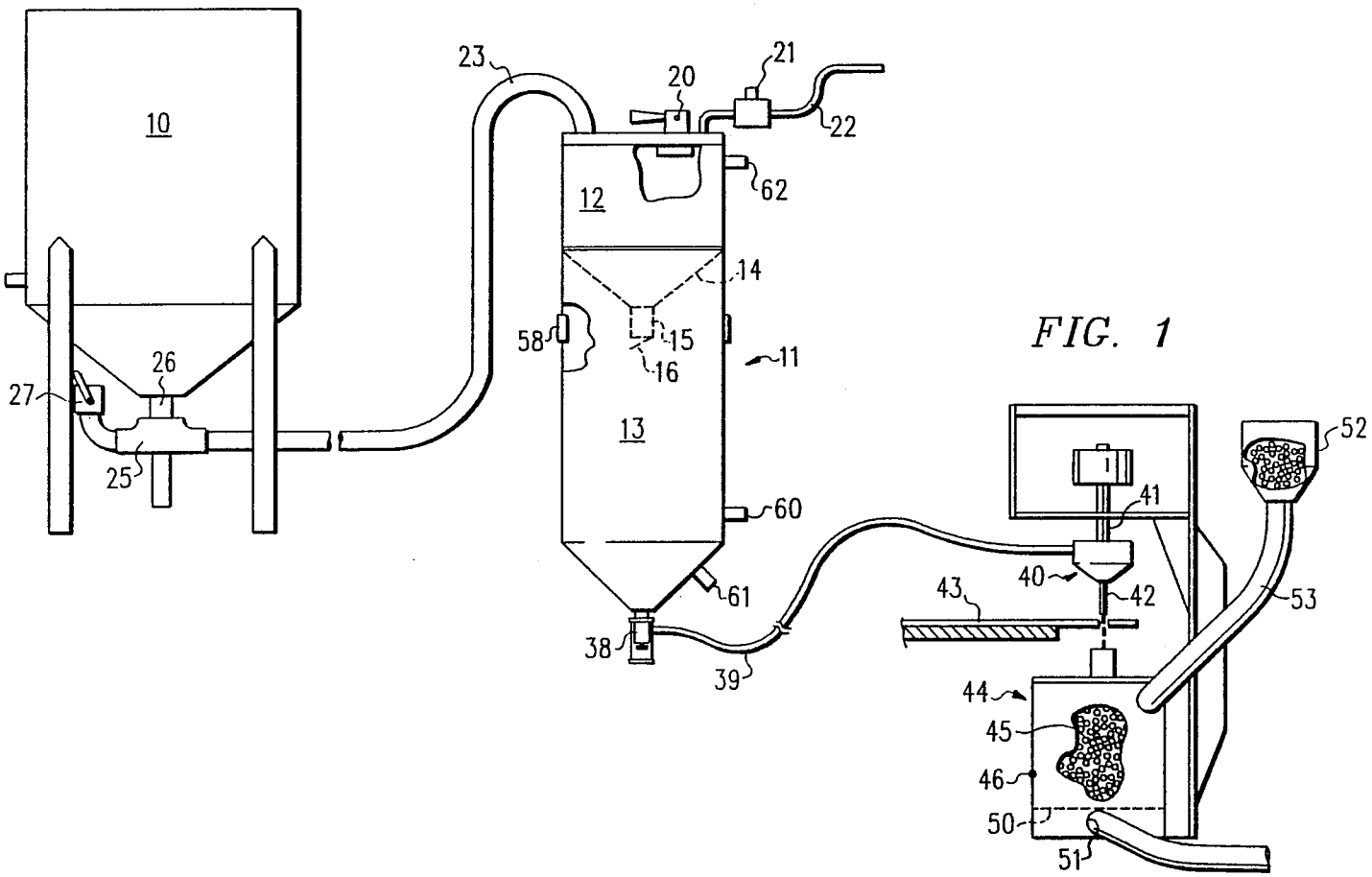
FIG. 1 is a partially diagrammatic representation of the material transfer system with portions cut away for clarity.
Figure 2:
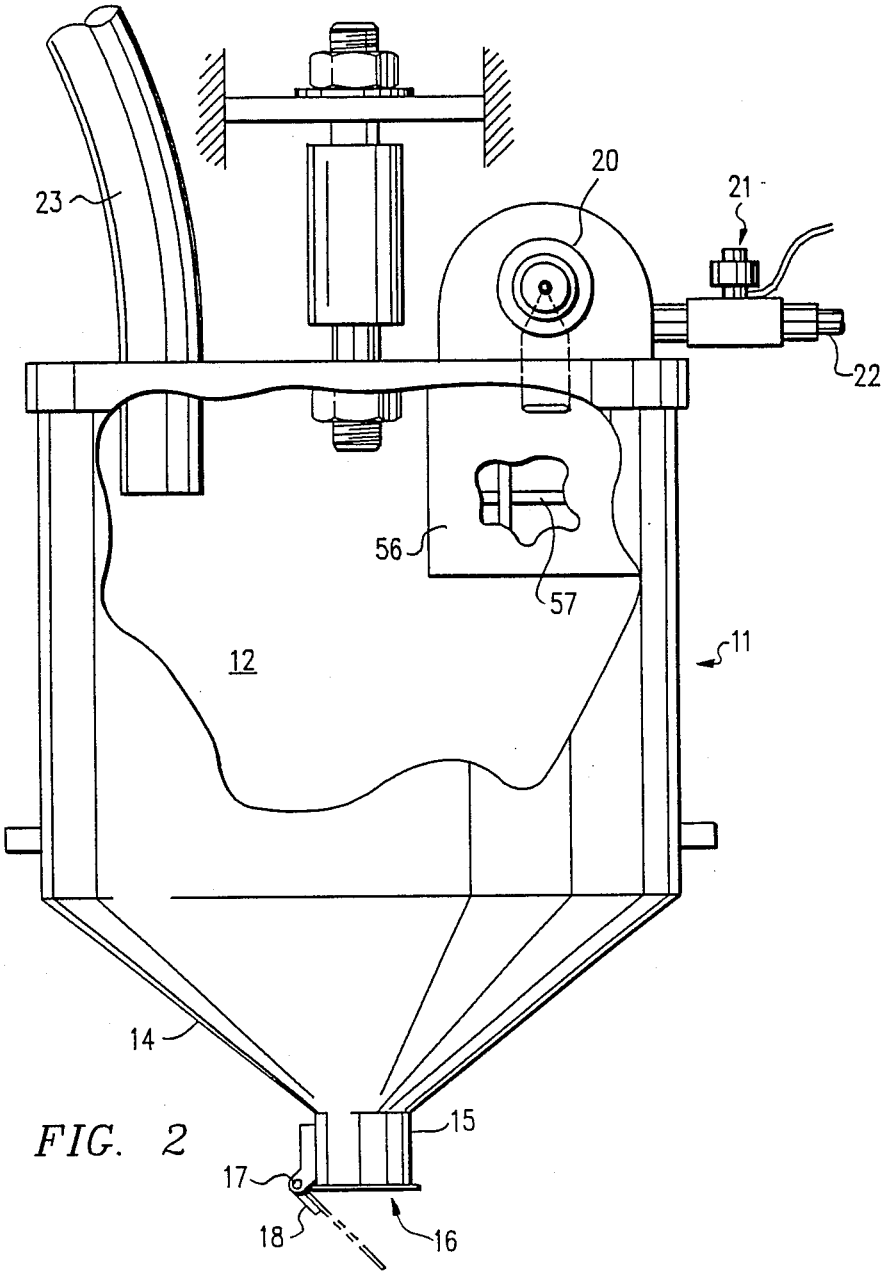
FIG. 2 is a side elevation, partially broken away, of the upper portion of the secondary hopper and the upper chamber, with associated components.
Figure 3:
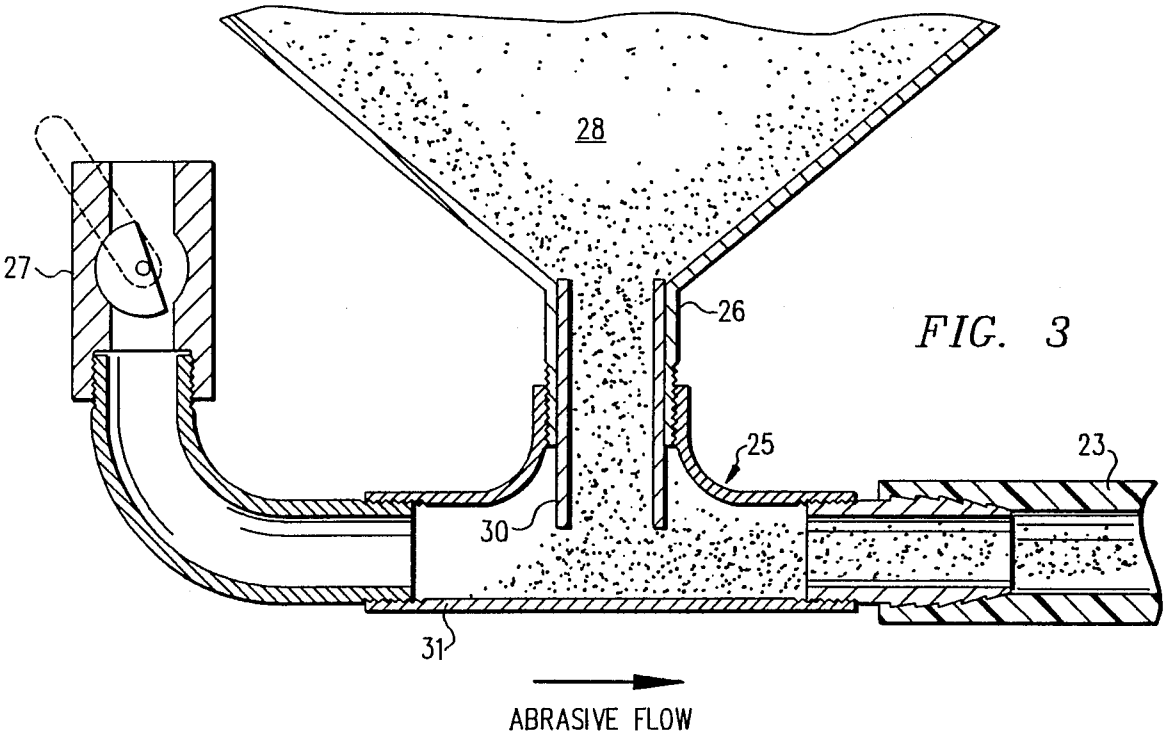
FIG. 3 is a cross-sectional view of the lower portion of the primary hopper and the T-fitting and supply conduit.
Figure 4:
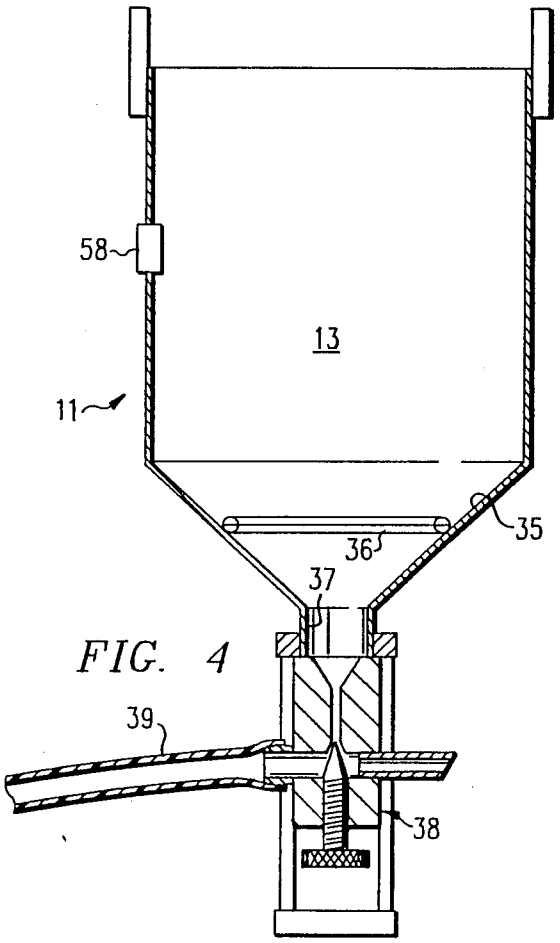
FIG. 4 is a cross-sectional view of the lower portion of the secondary hopper.

Referring primarily to FIG. 1, the preferred embodiment includes a primary storage means or hopper 10 for receiving and storing a quantity of the abrasive, and a secondary storage means or hopper assembly 11 for storing a quantity of the abrasive material at a location more closely adjacent to the work area. Suitably, the secondary hopper 11 may be carried by or mounted adjacent a robot (not shown), when the system is employed in an automated. robotically operated system. The secondary hopper 11 includes upper and lower chamber portions 12 and 13, the upper chamber 12 being defined by a frustoconical partition 14 affixed coaxially within the secondary hopper between the upper and lower chambers. At the lower apex of the frustoconical partition 14 an outlet 15 is formed communicating with a downwardly extending conduit having a check valve 16 mounted at its lower end portion. Referring additionally to FIG. 2, the upper chamber portion of the secondary hopper is shown in greater detail. The check valve 16 is hinged to the lower portion of the frustoconical partition 14, as shown at pin 17, and a stop member 18 is provided for holding the valve element in a partially open position upon its being permitted to open under its own weight and that of any particulate abrasive material contained in the upper chamber 12. The check valve 16 may be translated to and maintained in a closed position, sealing the outlet 15, upon the application of a vacuum to the upper chamber portion 12. Such a vacuum is suitably effected by an air operated venturi vacuum pump 20, controlled by a servo controlled solonoid valve 21 communicating between the pump 20 and conduit 22, the pump 20 being supplied with air under pressure at, for example, 60–90 p.s.i. The evacuated, upper chamber 12 and the air operated vacuum pump 20, along with a supply conduit 23 extending to the primary storage hopper 10, comprise means for transferring particulate material from the primary storage hopper 10 to the secondary hopper 12, as will be described in more detail. The supply conduit 23 may be extended for a substantial distance, i.e., for 80–120 feet. As seen, more clearly in FIG. 3, the inlet to the supply conduit 23 connects via a tee fitting 25 of an outlet 26 communicating with the bulk hopper 10. An airflow regulator 27 is provided for adjusting airflow permitted to enter the T-fitting 26 and supply conduit 23 in response to a vacuum applied to the conduit 23. This valve 27 thus adjusts the airflow past the outlet 26, which induces a flow of abrasive material 28 through the conduit 23 to the upper chamber 12 of the secondary hopper. As seen in FIG. 3, T-fitting 25 preferably includes a downwardly projecting tube section 30, which extends within the horizontally extending supply tube or pipe fitting 31 by a distance equal to one-third to one half the internal diameter of the horizontal section 31. Absent the projecting tube section 30, the particulate material 28 tends to back up, as a conical heap, against the top of the horizontal section 31, thereby stopping up and interrupting the flow of abrasive along the supply conduit 23. The T-fitting, 25 and valve 27 thus provide a continuous flow at a suitable flow rate, and the T-fitting is effective to prevent interruptions which could, as suggested above, entail catastrophic results with respect to the cutting of laminated composite workpieces. Because a substantial vacuum may be applied to the upper chamber portion 12 (FIG. 2), the secondary hopper may be located, as suggested above, at a substantial distance from the primary hopper 10. Referring to FIG. 4, the secondary hopper lower chamber 13 is provided with a frustoconical bottom wall portion 35 communicating through an outlet 37 and a screw controlled outlet valve 38, connected to outlet conduit or hose 39. A protective grid or screen 36 extends across the bottom wall portion 35.

Referring again to FIG. 1, the abrasive water jet cutter nozzle assembly 40 is suitably of a type such as that available as Model No 425 from Flow Systems, Inc. and includes a water inlet 41 communicating with a source of water under high pressure, (not shown), and a carbide nozzle 42 for directing the abrasive water jet cutting stream toward the workpiece 43. The exhausted flow is suitably collected in a receptacle or catcher 44 positioned in alignment with the nozzle on the opposite side of the workpiece, and the catcher is suitably provided with a plurality of sacrificial metallic elements, i.e., stainless steel balls 45, for absorbing the energy and abrasive action of the abrasive flow and preserving the structural integrity of the housing 46 of the catcher 44. A grid member 50 is disposed beneath the sacrificial elements 45 for permitting the water jet flow, abrasive, and abraded elements of the sacrificial balls 45, to exhaust through outlet 51 to a suitable drain, not shown. a supply container or hopper 52 is provided with a downwardly sloped outlet conduit 53 communicating with the interior of the catcher 44 for providing a continuous supply of the sacrificial elements 45 as they are abraded away by the flow of abrasive liquid. Alternatively, if the area below or on the opposite side of the workpiece 43 is clear of obstructions, a conventional catcher or container (not shown) may be provided, or the abrasive stream may be ejected to an otherwise suitable container or the like. When it is required to cut upwardly or perpendicularly projecting fins, or the like, it may be necessary or desirable to direction the abrasive jet along a horizontal axis, whereupon the catcher 44 is provided with a laterally extending inlet opening for releasing the spent abrasive stream.

In operation, abrasive is loaded into the the primary hopper 10 which feeds, under gravity, through the outlet 26 and into the T-fitting 25. A vacuum induced within the upper chamber 12 of the secondary hopper 11 extends within the supply conduit 23, and the airflow regulator 27 is open to permit a desired airstream velocity through the supply conduit 23. The airflow draws the abrasive from the T-fitting 25 and hopper 10, through the supply conduit 23, and into the upper chamber 12, and the flow is permitted to continue until the upper chamber is filled. (It is preferable that the upper chamber 12 be of a volume somewhat smaller than that of the lower chamber 13, in that, in operation, the upper chamber is required to be filled while sufficient abrasive remains in the lower chamber to supply the nozzle 40 as the upper chamber is being refilled.) Upon the upper chamber 12 being filled, the vacuum may be shut off, permitting the weight of the abrasive in the upper chamber 12 to open the check valve 16; the abrasive then flows into the lower chamber 13. After exhaustion of the abrasive from the upper chamber 12, the abrasive continues to flow from the lower chamber 13 until the valve 21 is again opened to permit airflow to the venturi pump 20, whereupon the check valve 16 is closed by the differential pressure between chambers 12 and 13 and remains closed so long as the upper chamber 12 is evacuated. The above-described operational steps are under the control of a control processor unit 60 (FIG. 4) as will be described in more detail below. The diameter of the outlet 15 of the upper chamber 12 is substantially larger than that of the outlet 37 and control valve 38 from the lower chamber 13 whereby, upon the vacuum being released and the check valve 16 opened, abrasive within the upper chamber portion 12 is quickly transferred to the lower chamber portion 13 before the abrasive within the lower chamber portion 13 is exhausted. Accordingly, the upper chamber 12 is successively filled and dumped into the lower chamber portion 13 while the abrasive from the lower chamber of portion 13 is continuously flowing, under gravity and under the vacuum produced at the cutting nozzle 40, for providing a continuous, uninterrupted flow to the nozzle 40.

Referring to FIG. 2, a filter 56, comprising a fabric surrounding a grid basket 57, is supplied at the inlet of the air operated venturi vacuum pump 20 for preventing dust and abrasive from entering the pump or exiting into the surrounding environment. A filtered vent 58 (FIG. 1) is provided in the side portion of the lower chamber portion 13 for permitting displaced air to exit from the chamber 13 as the abrasive is fed into that portion from the upper portion 12.

In the embodiment illustrated in FIG. 1, a plurality of level sensors, suitable of the type manufactured by Omron, Inc. as model E2K-C25ME1, are provided for providing signals to a central processor 60, to be described. The sensors are employed for actuating a control system and/or providing signals to an operator monitoring the operation of the system such signals being indicative of the abrasive level within the respective chambers 12 and 13. In the embodiment shown in FIG. 1, a low level sensor 60 is mounted through the wall of the secondary hopper 11 adjacent the upper mid portion of the lower chamber 13 for providing an indication that the level of abrasive within the lower chamber 13 is sufficiently low that a further supply of abrasive is required. A second sensor 61 is provided at an even lower level, and its output is indicative that a dangerously low level has occurred and that the system should thus be shut off. A high level sensor 62 is provided at the upper portion of the upper chamber 12 for providing a signal to the processor to the effect that the upper chamber 12 has been filled with abrasive.

Figure 5:
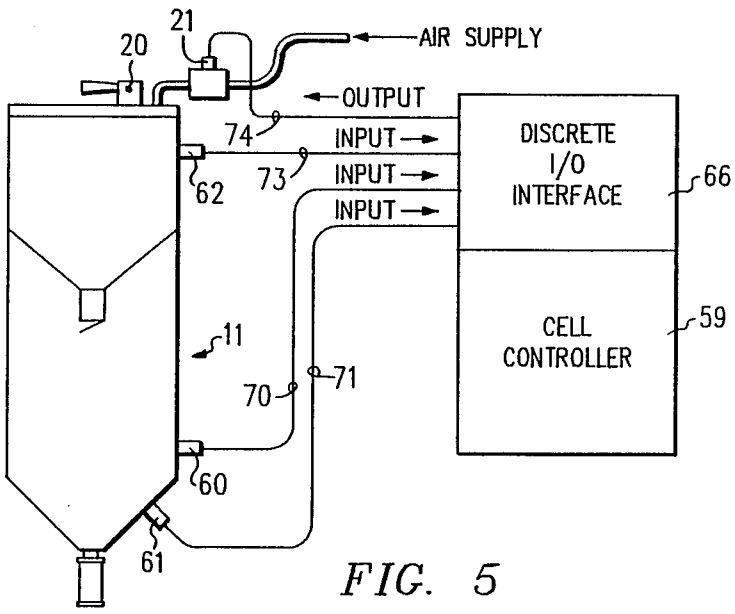
FIG. 5 is a schematic block diagram of the control system for the embodiment of FIGS. 1–4.
Figure 6:
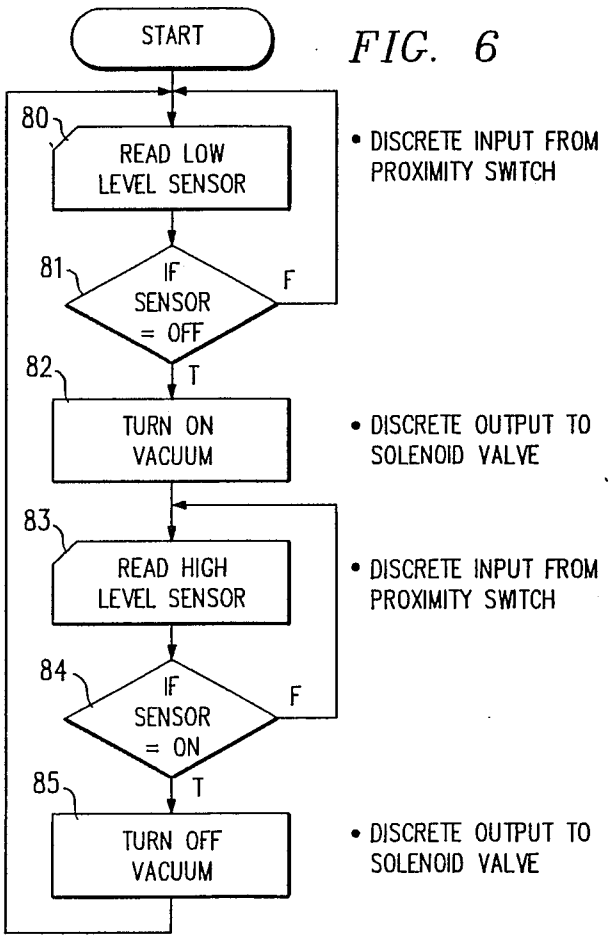
FIG. 6 is a computer flow diagram illustrating the operation of the control system of the present invention utilized in connection with the embodiment of FIGS. 1–5.

Referring to FIG. 5, the control system for operation of the material transfer system will now be described. Microprocessor 59 may be a microcomputer such as an IBM PC/AT or other comparable computer, and it is provided in a circuit which is connected for controlling the solonoid valve 21 which actuates the venturi vacuum pump 20. Input leads 70, 71 are connected to a discrete input/output interface 66 to the processor. Input lead 71 is connected to the low level sensor 60, and input lead 70 is connected the high level sensor 61, in the lower chamber 13. Input lead 73 is connected to the input/output interface 66 from the high level sensor 62. Output signal conductor 74 is, in turn, connected from the input/output device to the control solonoid 21, which controls the input of high pressure air to the venturi pump 20. Upon initial operation of the system from a down state in which there is no abrasive in either the upper or the lower chambers 12, 13 but in which the primary hopper 10 has been filled, the low level sensor 60 (FIG. 5 and FIG. 1), is read and, since the chamber 12 is empty, the processor 60 is programmed to actuate solonoid valve 21 to open the valve and provide communication of high pressure air to the venturi pump 20 to evacuate the upper chamber 12 and transfer abrasive to the upper chamber. Referring to the computer flow chart of FIG. 6, low level sensor positive output is read at read step 80. This output communicates to action block 81 to turn the vacuum pump on, at block 82, after which the high level sensor 62 is read, at block 83. If the upper chamber 12 is not yet full, the output of the high level sensor 62 will be negative and the high level sensor 83 will again be read, repetitively, until a positive input is received from sensor 62 indicative of filling of the upper chamber, at which time the vacuum will be turned off, as shown in action block 84 and block 85. As discussed in previously, upon the vacuum being turned off, the abrasive is free to fall into the lower chamber 13 until sensor 60 senses the abrasive ("read" block 84 of FIG. 6) is turned off the vacuum. the the low level sensor is continually read. The the logic cycle represented by blocks 80 and 81 is repeated until the abrasive within the lower chamber becomes low, at which time, again, the vacuum is turned on.

Figure 7:
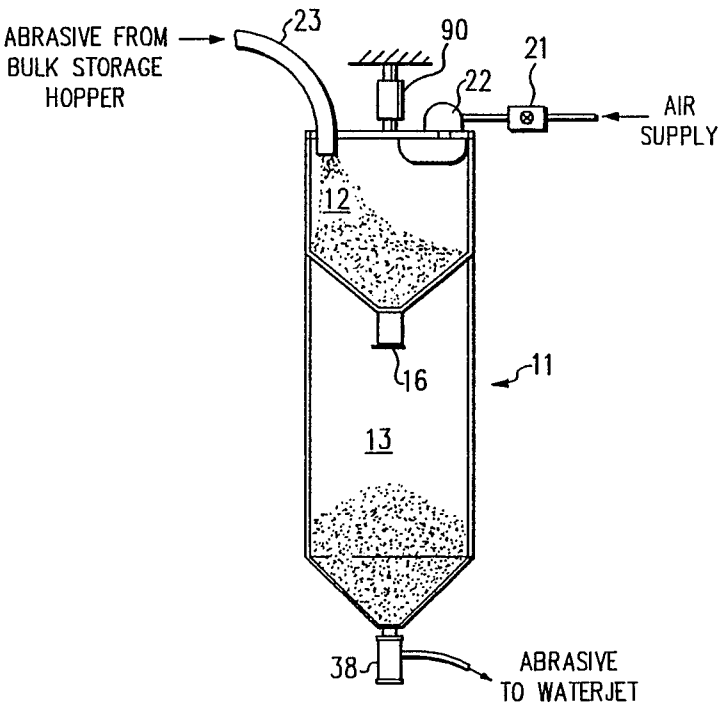
FIG. 7 is a cross-sectional view of the secondary hopper; constructed according to a second embodiment.
Figure 9:
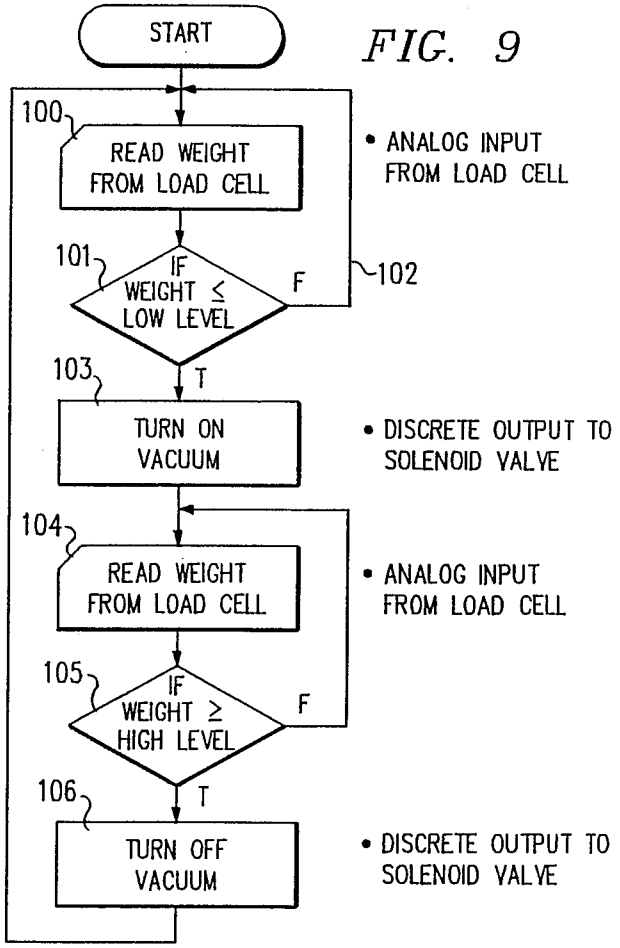
FIG. 9 is a computer flow diagram illustrating the operation of the embodiment of FIG. 3.
Figure 8:
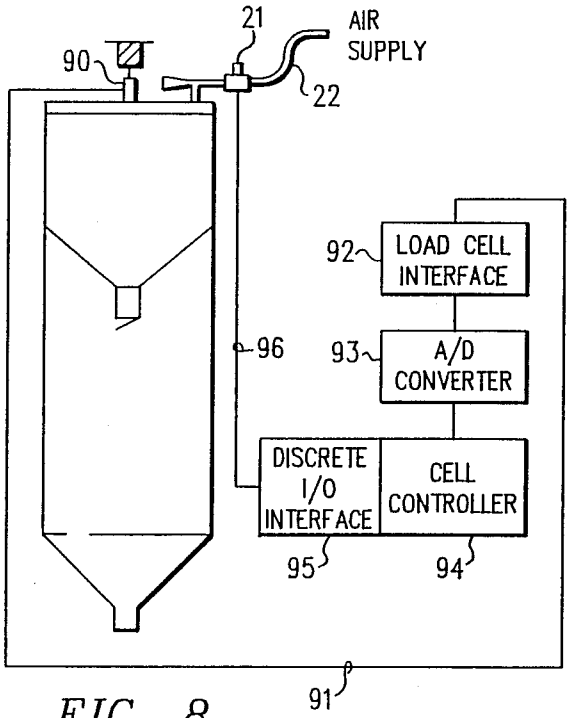
FIG. 8 is a block diagram of the control system of the second embodiment of the present invention.

Referring now to FIG. 7–9, a second embodiment of the system is similar to the embodiment of FIG. 1–6 except that the sensors 60, 61, and 62 are not required and a load cell 90 is employed for determining the gross weight of the secondary hopper 11, including the weight of the abrasive in both the upper and lower chambers 12, 13. The load cell 90 may suitably be a transducer such as that manufactured by the Sensotec Company as a rod-end-male load cell model RM-1K, with model no. 450d amplifier. As seen in FIG. 7, the load cell is connected to the upper portion of the secondary hopper 11 and suspends the secondary hopper 11 from an upper support. It emits a signal indicative of the overall weight of the assembly. With additional reference to FIG. 8, the its output signal constitutes a very low level voltage signal which is transmitted over input lead 91 to a load cell interface circuit 92 which comprises a linear analog voltage amplifier which is employed for amplifying the signal to a level suitably of approximately 0–10 volts. The output of load cell interface 90 is transmitted to an analog to digital converter 93 whose output is a series of coded signals, i.e., 8-bit counts, suitably in the range from 0–255. The digital output from the a - d converter 93 is transmitted to the microprocessor 94, which monitors the output of the cell controller 90 for determining the existence of predetermined, high and low levels. For example, a high level output of 175 may correspond, to a total gross weight of the secondary hopper of 70 pounds, and a low level of 75 may correspond to a weight of 30 pounds. The predetermined high level of 70 pounds is indicative that both chambers 12 and 13 are full. A low level, of 30 pounds, is indicative of a low level condition in which additional abrasive is required.

Upon the occurrence of the low level signal, an acquisition command is issued by the cell controller 94 and a power signal is emitted by the discrete input/output circuit 95 to the solonoid valve 21, opening the valve and turning on the flow to the venturi pump 22 for evacuating the upper chamber 12 and transferring additional abrasive to the upper chamber 12, as described above.

Referring additionally to FIG. 9 and again assuming that a start up condition is present in which no abrasive is present in the secondary hopper 11, the gross weight of the hopper will be below the 30 pound level and it is read, at block 100, FIG. 9. The output indicating a low level is fed through decision block 101 which emits a true "output" to decision block 103, turning on the vacuum pump (effecting filling of the upper and lower hoppers with abrasive, according to the process previously described). An output command is transmitted by the discrete input/output 95 (FIG. 8) through lead 96 to actuate the solonoid valve 21. At block 104 the weight is repetitively read from the load cell and, at decision block 105, a false output is emitted so long as the weight remains below the full level of 70 pounds (corresponding to a digital code value of 175). So long as the weight is below the high level of 70 pounds, a false output is emitted from decision block 105, and the weight is read again. Upon the weight rising about 70 pounds, a true output is emitted to read block 106, and the signal from discrete input/output 95 is turned off, turning off the vacuum. As will now be apparent from a consideration of the embodiments of FIGS. 1–6 and 7–9, various control systems may be employed for effecting the desired operation of the vacuum venturi pump 22. Additionally, it should be pointed out that the venturi vacuum pump described herein is employed because of its reliability and simplicity. In other applications however, other pumping apparatus may be employed, such as those employing an electrically drive pump motor or the like.

From the above description it will now be seen that the abrasive material transfer system of the present invention is operable to provide a continuous flow of abrasive at a constant rate to the abrasive cutting nozzle by means primarily of gravity flow, assisted at the terminal end of the conduit 39 by the vacuum induced by the venturi flow at the cutting nozzle assembly 40. In prior art, devices utilizing positive air pressure rather than a vacuum induced airflow, as in the present system, to effect transfer of the material from the primary hopper to the work station, it has been necessary to provide a substantially larger and less flexible supply pipe between the supply hopper and the workstation. Because the vacuum induced flow is constant and at a higher velocity, small diameter, flexible tubing may be employed for the supply conduit 23. This affords important advantages relative to increased mobility and reduced weight in the tubing connected to the robot, permitting greater freedom of movement. Because of the efficient transfer of abrasive to the upper chamber 12 under the vacuum induced flow, a continuous supply of abrasive may be supplied to the secondary hopper 11 from a substantial distance; nevertheless, the secondary hopper may be of such relatively small size that it is conveniently mounted upon a robot, or supported closely adjacent to the work area. The outlet conduit 39 from the secondary hopper 14 may be of sufficient length i.e., 15–20 feet, to provide further freedom of operation for the robot cutting assembly, or for a worker, without the requirement as in previous systems that the large primary hopper be located adjacent to the work area. In operation, the secondary hopper 14 may be cycled as often as necessary, and may be made relatively small and compact. As will be understood by those in the art, a greater frequency of exhaustion and filling of the upper chamber 12 is entailed if the secondary hopper 11 is of smaller volume.

While only one embodiment of the apparatus, together with modifications thereof, has been described in detail herein and shown in the accompanying drawing, it will be evident that various further modifications are possible in the arrangement and construction of its components without departing from the scope of the invention.

What is claimed is:

1. Apparatus for transferring particulate abrasive material to a liquid jet abrasive cutting nozzle, comprising:

a primary hopper means for receiving and storing a quantity of the abrasive material;

a secondary hopper means Remotely located relative to the primary hopper means for receiving a quantity of the abrasive material, the secondary hopper means having upper and lower chambers;

a conduit connected between the primary hopper means and the upper chamber of the secondary hopper means;

means for intermittently evacuating the upper chamber while maintaining the lower chamber at substantially atmospheric pressure and for intermittently effecting a differential pressure along the conduit which induces an intermittent flow of abrasive material from the primary hopper, through the conduit, and into the upper chamber of the secondary hopper;

valve means, communicating between the upper and lower chambers, for preventing communication between the upper and lower chambers upon the upper chamber being evacuated, and, alternatively, for providing communication between the upper and lower chambers upon the vacuum being released from the upper chamber, whereby the abrasive material within the upper chamber is permitted to pass from the upper chamber, through the valve means, to the lower chamber; and outlet and supply conduit means communicating between the lower chamber and the liquid jet abrasive cutting nozzle, the outlet means being disposed at a location below the lower chamber, and comprising means for ejecting abrasive material from the lower chamber "under atmospheric pressure". in a substantially continuous gravity fed stream uninterrupted during the intermittent flow of abrasive material and during the passage of abrasive material from the upper chamber to the lower chamber, whereby the abrasive material ejected from the lower chamber is permitted to flow through the conduit.

2. The apparatus of claim 1, wherein control means is provided for initiating a vacuum in the upper hopper portion upon the level of abrasive within the lower chamber portion falling below a predetermined level.

3. The apparatus of claim 1, wherein the control means comprises means for releasing the vacuum in the upper chamber upon the level of abrasive in the upper chamber rising above a predetermined level.

4. The apparatus of claim 1, wherein the control means comprises means for initiating a vacuum in the upper chamber upon the gross weight of the secondary hopper falling below a predetermined level.

5. The apparatus of claim 1, wherein the valve means communicating between the upper and lower chambers includes a valve passageway outlet having substantially greater area than the internal cross-sectional area of the outlet conduit means.

6. A method for transferring particulate material from a primary container to a secondary container "remotely located relative to the primary container". comprising:

providing partition means in the secondary container for defining upper and lower chambers within the secondary container;

providing valve means communicating between the upper and lower chambers;

providing a conduit in communication between the upper chamber and the primary container and an air inlet, to the conduit, beyond the primary container;

cyclically evacuating the upper chamber and inducing airflow and flow of particulate material from the primary container, through the conduit into the upper chamber while maintaining the valve means in a closed condition to prevent communication between the upper and lower chambers;

subsequently, opening the valve means for permitting transfer of particulate material from the upper to the lower chambers by gravitational force, further comprising the step of releasing particulate material from the lower chamber in a substantially continuous stream by gravitational force while maintaining the lower chamber at substantially atmospheric pressure and transferring said particulate material to a workstation, wherein the step of evacuating the upper chamber and inducing airflow and transfer of particulate material from the primary container into the upper chamber is repeatedly accomplished while particulate material remains in the lower chamber and flows therefrom in a substantially continuous stream which is continued during successive cycles of filling of the upper chamber with abrasive.

7. The method of claim 6, wherein during the step of releasing particulate material from the upper to the lower chamber, said material is permitted to flow through the valve means at a flow rate substantially greater than the rate at which particulate material is permitted to flow from the lower chamber to the workstation.

8. The method of claim 6, wherein particulate material is permitted to flow from the lower chamber to the workstation continuously during the step of supplying particulate material to the upper chamber under vacuum and the step of releasing said material to the lower chamber.

9. Apparatus for transferring particulate material, comprising;

primary storage means for receiving and storing particulate material;

moveable secondary storage means remotely located relative to the primary storage means. for receiving and storing a quantity of particulate material;

means for intermittently transferring particulate material from the primary storage means to the secondary storage means; and means for ejecting the particulate material from the secondary storage means under atmospheric pressure as a substantially uninterrupted gravity-fed stream during successive cycles of intermittent transfer of particulate material from the primary storage means to the secondary storage means.

10. The apparatus of claim 9, wherein the means for transferring particulate material from the primary storage means to the secondary storage means comprises a vacuum driven transfer means, and wherein the means for ejecting particulate material from the secondary storage means comprises gravity powered ejection means.

11. The apparatus of claim 9, wherein the secondary storage means includes a first storage chamber for receiving particulate material from the primary storage means, and a second storage chamber.

12. The apparatus of claim 11, including means for evacuating the first storage chamber while maintaining the second storage chamber at atmospheric pressure.

13. The apparatus of claim 12, including control means for effecting a transfer of particulate material to the first storage chamber upon the level of particulate material in the secondary storage chamber falling below a predetermined level.

* * * * *